United States Patent [19]

Williams

[11] Patent Number: 4,841,659

[45] Date of Patent: Jun. 27, 1989

[54] SIGHT OVER SCOPE GUN SIGHT

[76] Inventor: Paul D. Williams, 9241 Davison, Davison, Mich. 48423

[21] Appl. No.: 62,764

[22] Filed: Jun. 15, 1987

Related U.S. Application Data

[63] Continuation of Ser. No. 579,464, Feb. 13, 1984.

[51] Int. Cl.[4] ..... F41G 1/38

[52] U.S. Cl. ..... 42/101; 33/245; 33/261

[58] Field of Search ..... 42/100, 101; 33/245, 33/261, 246–258

[56] References Cited

U.S. PATENT DOCUMENTS

| | | | |
|---|---|---|---|
| D. 253,545 | 11/1970 | Chesnut | D22/8 |
| 374,202 | 12/1887 | Rice | 33/247 |
| 1,291,692 | 1/1919 | Wright | 42/100 |
| 2,054,090 | 9/1936 | Marple | 42/101 |
| 2,377,704 | 6/1943 | Loomis | 33/252 |
| 2,777,202 | 1/1957 | Conte | 33/245 |
| 3,193,932 | 7/1965 | Johnson | 42/1 S |
| 3,199,202 | 8/1965 | Williams | 33/258 |
| 3,626,597 | 12/1971 | Darrah | 33/252 |
| 3,671,000 | 6/1972 | Williams | 33/245 |
| 3,834,035 | 9/1974 | Merrill | 42/1 S |
| 3,975,851 | 8/1976 | Benford | 42/1 S |
| 4,008,536 | 2/1977 | Adams | 42/100 |
| 4,313,273 | 2/1982 | Matthews et al. | 42/101 |
| 4,561,204 | 12/1985 | Binion | 42/1 ST |

FOREIGN PATENT DOCUMENTS

| | | | |
|---|---|---|---|
| 1572356 | 7/1980 | United Kingdom | 33/245 |

*Primary Examiner*—Deborah L. Kyle
*Assistant Examiner*—Michael J. Carone

[57] ABSTRACT

A firearm sighting device is described which provides a dual iron and telescopic sighting systems for the shooter. Iron sights are added to a modified telescopic sight upper mounting rings which are attached to conventional telescopic sight lower mounting rings. The modified upper rings include means for correcting for alignment, windage and trajectory. The modified upper rings also include dovetail slots, enabling various types of front and rear sight elements to be employed. For example, the rear sighting element may interchangeably be provided with a peep type sight or an open blade sight. Likewise, the front sight may include a bead or blade sighting element.

21 Claims, 2 Drawing Sheets

SIGHT OVER SCOPE GUN SIGHT

This is a continuation of U.S. Pat. application Ser. No. 579,464, filed Feb. 13, 1984 entitled SIGHT OVER SCOPE GUN SIGHT.

BACKGROUND AND SUMMARY OF THE INVENTION

This invention relates to a gun sight and particularly, to a gun sight which employs an iron sight positioned above a telescopic sighting device such that the user may employ either sighting system as desired.

Generally, two different classes of sighting systems are available to firearm shooters: telescopic sights and so-called iron sights. Telescopic sights provide excellent accuracy over long ranges since they optically enlarge the target image. Most telescopic systems however, have limited utility in low ambient light conditions. Iron sights do not provide the accuracy of telescopic sighting systems over long ranges since they do not present an enlarged target image. These sights are, however, superior in low light conditions. Moreover, iron type sights generally permit faster aiming of the firearm which is particularly advantageous when shooting at targets which are close and moving.

In addition to the advantages of the various type of sights, different types of iron sights are available. For example, many sportsmen prefer so-called "peep" type sights while others prefer an open blade type iron sight. Furthermore, the accuracy of any sighting system is influenced by the rigidity of its connection to the associated firearm. Absent sufficient rigidity, sights become unreliable and must be frequently realigned. Sighting systems further must be provided means for alignment, windage and trajectory compensations. Moreover, it is desirable to provide a means by which the sight may be readjusted from one alignment to a second alignment and thereafter returned to the first alignment position. Such readjustment is necessary, for example, when different types of projectiles or loads are used, or when shooting at various ranges from the target. Due to the distinct advantages of each type of sighting system, many sportsmen prefer to have a convertible or dual sighting system which includes both telescopic and iron sighting elements. Typically, such dual sighting systems employ a telescopic sight mount which features an aperture between the telescopic gun sight and the firearm receiver, which includes iron sighting elements. Such systems, however, require a specially designed telescopic sight mount and also requires that the telescopic sight be mounted high above the firearm receiver, thus making the gun somewhat more bulky than otherwise necessary and, in some instances, interfering with proper alignment of the gun with respect to the shooter.

In another type of dual sighting system, an iron sight is provided which is located above the telescopic sight. Such systems are generally described by the following U.S. Pat. Nos. 3,626,579 issued to C. R. Darrah on Dec. 14, 1971; 2,054,090 issued to M. M. Marple on Sept. 15, 1936; and Des. 253,545 issued to M. G. Chestnut on Oct. 27, 1979. The structures described by these references, however, have numerous shortcomings including lack of mount rigidity and sighting element interchangeability, high cost and limited or nonexistent alignment adjustment capability. None of these references teach or suggest the numerous benefits and advantages of the gun sight according to this invention.

In view of the above, it is a principal object of this invention to provide an improved combination telescopic and iron sighting system featuring an iron sight mounted above a telescopic sight. It is another aspect of this invention to provide an iron sight usable in connection with existing telescopic sight mounting components thereby improving mount rigidity and reducing costs. It is still another aspect of this invention to provide a dual telescopic and iron sighting system which provides iron sights which are adjustable over a wide range for alignment windage and trajectory correction, and which further provides interchangeability of sighting elements. It is yet an additional aspect of this invention to provide an iron sighting system having elements which may be set to a predetermined alignment position.

The above principal aspects of this invention are provided by employing modified front and rear telescipic sight top mounting rings which receive front and rear iron sighting elements. These elements are provided with adjustment means for alignment, windage and trajectory compensation.

Additional benefits and advantages of the present invention will become apparent to those skilled in the art to which this invention relates upon a reading of the described preferred embodiments of this invention taken in conjunction with the accompanying drawings.

DETAILED DESCRIPTION OF THE INVENTION

Figure 1:
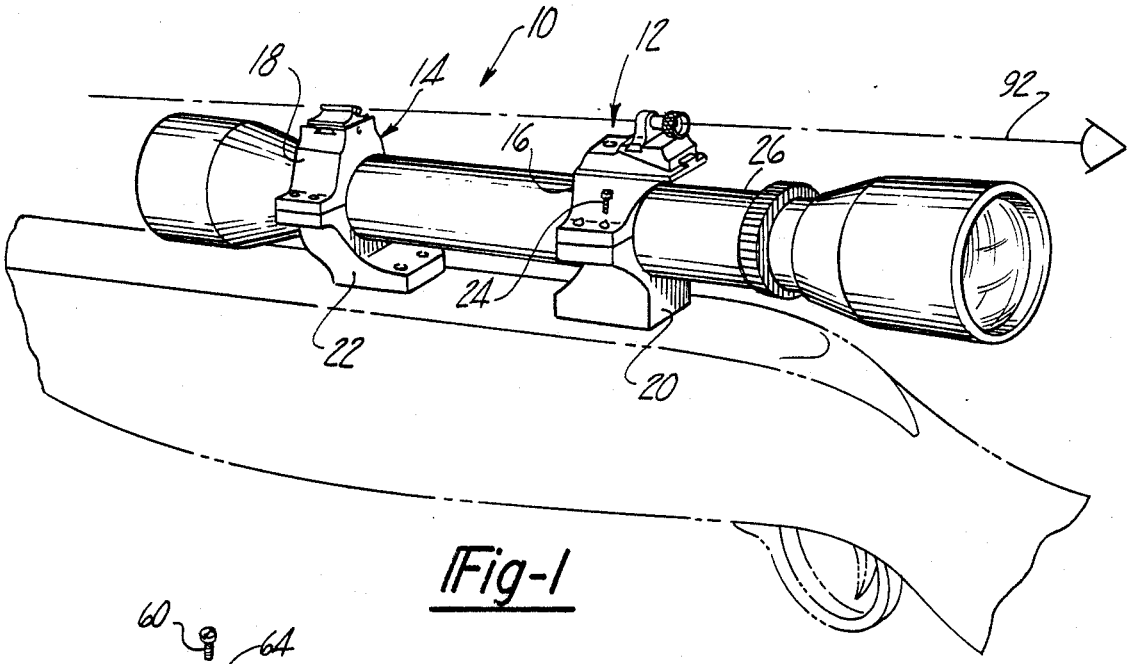
FIG. 1 is a pictorial view of the gun sight according to this invention depicting the typical environment with which this invention is most advantageously employed, including a portion of a rifle and a telescopic sight with conventional front and rear lower mounting ring portions.
Figure 2:
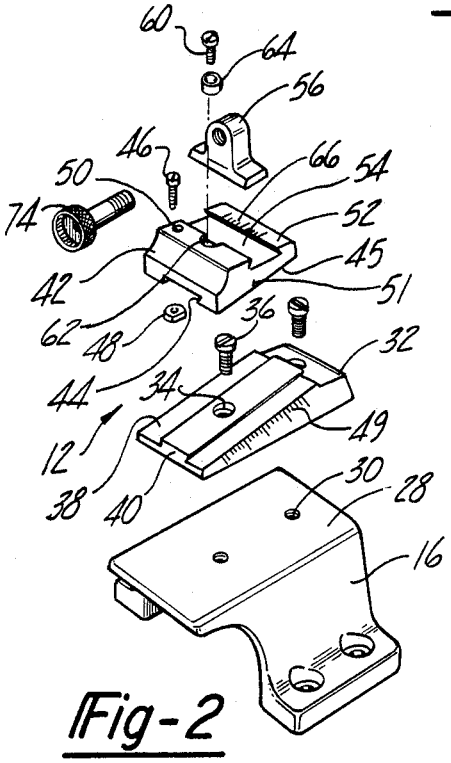
FIG. 2 is an exploded pictorial view of the rear sight assembly according to this invention wherein a peep sight aperture is provided.
Figure 6:
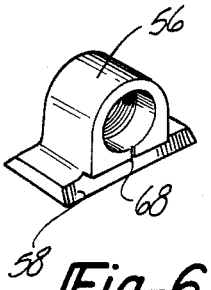
FIG. 6 is a pictorial view of the peep sight body of the rear sight assembly depicted particularly by FIGS. 2 through 5.
Figure 3:
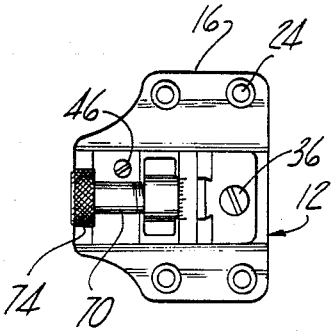
FIG. 3 is a top view of the rear sight assembly shown by FIG. 2.

The sight over scope gun sight according to this invention is depicted by FIG. 1 and is generally designed by reference character 10. Gunsight 10 includes rear sight assembly 12 and front sight assembly 14. Each of the sight assemblies 12 and 14 include modified rear and front upper mounting ring portions, rear iron sight ring portion 16 and front iron sight ring portion 18.

Upper sight ring portions 16 and 18 engage lower mounting ring portions 20 and 22, respectively, and are affixed thereto by threaded fasteners 24. Lower mounting rings 20 and 22 are of the type which is conventionally employed to mount a telescopic sight 26 to a firearm receiver. The upper sight ring portions 16 and 18 according to this invention replace existing upper mounting ring portions normally used with conventional telescopic sight mounting systems. Telescopic sight 26 and lower mounting ring portions 20 and 22 are therefore conventional, enabling existing telescopic mount structures to be retrofitted for use in connection with devices according to this invention. Moreover, by mounting sight assemblies 12 and 14 directly to lower mounting ring portions 20 and 22, a very rigid mounting for the iron sights results.

Rear sight assembly 12 includes upper sight ring portion 16 which forms a semicircular lower surface 27 which engages telescopic sight 26 and substantially flat top surface 28. A pair of threaded bores 30 are formed within top surface 28. Affixed to top surface 28 is wedge-shaped rear sight ramp 32. Ramp 32 includes a pair of bores 34 which are aligned with bores 30 and permit the ramp to be affixed to upper sight ring 16 by threaded fasteners 36. Rear sight ramp 32 includes an upper surface 38 which extends along a plane which is inclined with respect to top surface 28 and further forms a projecting dovetail flange 40. Sliding sight block 42 includes a cooperatively shaped dovetail solt 44 within the bottom surface 45 thereof which engages with dovetail flange 40 such that sight block may be sild along upper surface 38. A desired position of sight block 42 is fixed with respect to rear sight ramp 32 by adjustment set screw 46 which engages adjuster nut 48 and passes through bore 50. Adjuster nut 48 engages dovetail flange 40 such that when adjuster screw 46 is tightened, dovetail flange 40 is clamped by adjuster nut 48 such that the position of sight block 42 is adjustably fixed with respect to rear sight ramp 32. As sight block 42 is slid with respect to rear sight ramp 32, the distance between sight block 42 with respect to the rifle receiver changes. Such adjustment is desired in order to compensate for trajectory variations. A preselected relative positioning between sight block 42 and rear sight ramp 32 is provided by forming a graduated index scale on either of these parts which, when used with an index mark on the other, permits a preselected relative positioning to be achieved. Such a graduated scale 49 is formed on sight ramp 32 whereas index mark 51 is formed on sight block 42.

Sight block 42 includes a top surface 52 which forms a dovetail slot 54. Dovetail slot 54 extends along a line which is perpendicular to a line extending along bottom dovetail slot 44. Disposed within dovetail slot 54 is peep sight body 56, which includes a dovetail flange 58 which cooperates with dovetail slot 54, enabling the peep sight body to be slid into position on sight block 42. Peep sight barrel 70 threadingly engages peep sight body 56 and includes internal bore 72 and hood 74. The position of peep sight body 56 along dovetail slot 54 is adjustably fixed by providing set screw 60 which engages threaded bore 62 and is employed to cause washer 64 to clamp dovetail flange 58 when the set screw is tightened. A predetermined positioning between peep sight body 56 with respect to sight block 42 and, in cooperation with index mark 68, permits such positioning to be set to a desired position. Rear sight assembly 12 is constructed to provide adjustment for bore alignment, windage and trajectory of the projectiles being discharged by the firearm. Windage adjustment is achieved by moving peep sight body 56 laterally along dovetail slot 54. Adjustment for the trajectory of the projectile over different ranges and for different types of projectiles is achieved by sliding sight block 42 along rear sight ramp 32. Bore alignment is achieved by adjusting the positions of both peep sight body 56 and sliding block 42, as needed.

Figure 7:
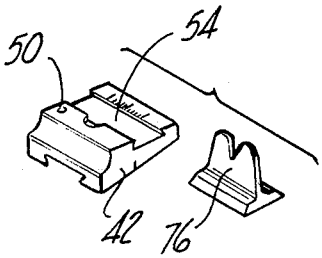
FIG. 7 is a pictorial view of an alternate embodiment of the rear sight assembly according to this invention wherein an open blade type sight element is provided.
Figure 5:
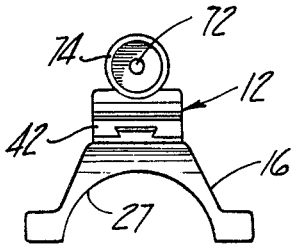
FIG. 5 is a rear view of the rear sight assembly shown by FIG. 2.
Figure 4:
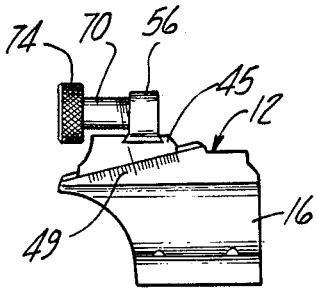
FIG. 4 is a side view of the rare sight assembly shown by FIG. 2.
Figure 8:
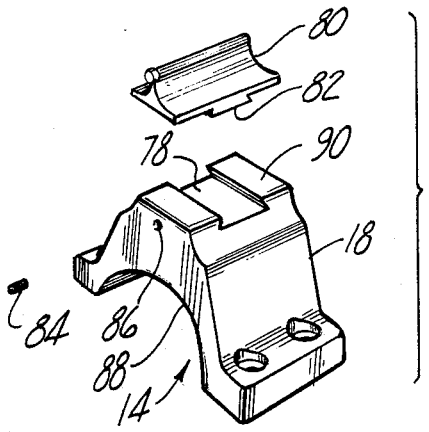
FIG. 8 is an exploded pictorial view of the front sight assembly according to this invention.
Figure 9:
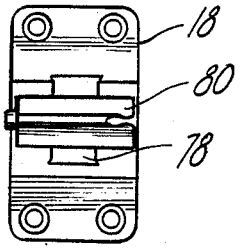
FIG. 9 is a top view of the front sight assembly shown by FIG. 8.
Figure 10:
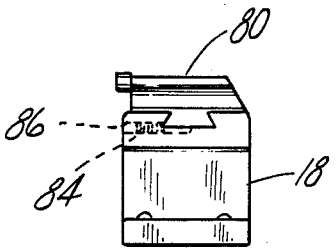
FIG. 10 is a side of the front sight assembly shown by FIG. 8.
Figure 11:
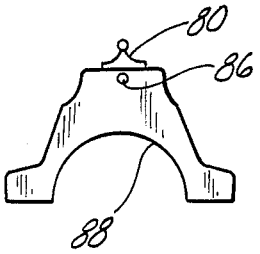
FIG. 11 is a rear view of the front sight assembly shown by FIG. 8 according to this invention.

An alternate embodiment of rear sight assembly 12 is depicted by FIG. 7, wherein open blade type rear sight 76 engages sight block 42, through cooperation with dovetail slot 54. Rear sight assembly 12 is therefore quickly convertible between a peep type rear sighting element designated by reference characters 56 and 70 and an open blade sight type rear sighting element designated by reference character 76. Any number of additional sight elements could be provided for use in connection with rear sight assembly 12 according to this invention.

Front sight assembly 14 is particularly shown with reference to FIGS. 8 through 11 and, like sighting element 12, is adapted to engage a conventional lower mounting ring 22 and is fastened thereto by threaded fasteners 24. Front sight assembly 14 includes upper sight ring portion 18 having a semicircular lower surface 88 engaging telescopic sight 26 and a top surface 90 forming dovetail slot 78 extending along a direction perpendicular to the optical axis of the telescopic sight. Frong sight element 80 is preferably a pin or bead type front sight which includes dovetail flange 82 which engages dovetail slot 78, enabling front sight 80 to be installed onto upper sight ring 18. Frong sight element 80 is held at a desired position with respect to dovetail slot 78 by set screw 84 which is threadingly engaged within bore 86 and bears upon the dovetail flange when tightened. Front sight assembly 14 offers the same advantages of rear sighting element 12 in that various types of sight elements may be installed within the associated dovetail slots. Moreover, front sight 80 may be moved laterally with respect to the bore axis of the associated firearm, thereby providing additional windage and alignment correction. For this purpose, a graduated index scale and index mark (not shown) may be provided for front sight assembly 14 as explained in connection with rear sight assembly 12.

In operation, telescopic sight 26 may be used as it would be conventionally. If, however, the user desired to employ iron sights, the firearm would be lowered slightly or the user's head raised such that the position illustrated by FIG. 1 is achieved whereby the sighting axis 92 passes through the front and rear sighting elements. This sighting system therefore enables rapid interchangeability by the shooter betweein iron and telescipic sighting systems. As is evident from FIG. 1, it is necessary to displace front and rear sighting elements a sufficient above telescopic sight 26 such that the sighting axis 92 does not coincide with any portions of the telescopic sight 26.

While the above description constitutes the preferred embodiments of the present invention, it will be appreciated that the invention is susceptible to modification, variation and change without departing from the proper scope and fair meaning of the accompanying claims.

I claim:

1. An iron sight in combination with a telescopic sight on a firearm such that the sighting axis of said iron sight is axially spaced farther from the bore axis of said firearm than the sighting axis of said telescopic sight, said iron sight comprising:

a front sight assembly disposed on said telescopic sight comprising a first means for adjusting the horizontal alignment relative to the sighting axis of said telescopic sight and a front sight element associated with said first adjustment means, and a rear sight assembly disposed on said telescopic sight comprising a second means for adjusting the horizontal and vertical alignment relative to the sighting axis of said telescopic sight and a rear sight element associated with said second adjustment means.

2. The sight according to claim 1 wherein said rear sight element is a peep type sight.

3. The sight according to claim 1 wherein said rear sight assembly comprises a plurality of interchangeable rear sight elements.

4. An iron sight in combination alternately with a telescopic sight on a firearm such that the sighting axis of said iron sight is axially spaced farther from the bore axis of said firearm than the sighting axis of said telescopic sight, said iron sight comprising a front sight assembly having a front sight ring portion associated with said telescopic sight and a front sight element disposed thereupon, and a rear sight assembly having a rear sight ring portion associated with said telescopic sight having a removable rear sight elements, means for alignment, windage and trajectory compensation of said iron sight relative to the sighting axis of said telescopic sight, and means for fixing the position of said rear sight element with respect to said telescopic sight.

5. The sight according to claim 4 wherein said rear sight element is a peep type sight.

6. The iron gun sight according to claim 4 wherein a first graduated scale is formed on said rear sight adjustment means whereby a predetermined horizontal positioning of said rear sight element may be set, and a second graduated scale is formed on said rear sight adjustment means whereby a predetermined vertical positioning of said rear sight element may be set.

7. An iron sight adapted to be used with a generally cylindrical telescopic sight including a pair of telescopic mount assemblies having mutually engaging upper and lower mounting ring portions of generally semicircular inner contour for holding said telescopic sight therebetween, said iron sight comprising:

a front sight assembly interchangeable with one of said upper mounting ring portions engageable with said lower mounting ring portion, said upper sight assembly having a generally semicircular surface for holding said telescopic sight and a sight element disposed on the surface generally opposite said semicircular surface, and a rear sight assembly interchangeable with another of said upper mounting ring portions engageable with said lower mounting ring portion, said upper sight assembly having a generally semicircular surface for holding said telescopic sight and a sight element disposed on the surface generally opposite said semicircular surface.

8. The sight according to claim 7 wherein a first of said sight assemblies comprises an integral sight surface slotted generally perpendicularly to the axis of said telescopic sight and said sight element having a flange slidably engageable within said slotted surface.

9. The sight according to claim 8 wherein said sight surface further forms a threaded bore for receiving a set screw engageable with said sight element whereby said sight element is releasably secured relative to said telescopic sight.

10. The sight according to claim 8 further comprising a plurality of interchangeable sight elements.

11. The sight according to claim 7 wherein one of said sight assemblies comprises a sight ramp disposed on said sight surface and having an upper surface forming a dovetail flange extending generally parallel to the axis of said telescopic sight, a sliding block having a lower surface forming a dovetail slot slidably engaging said sight ramp and having an upper surface forming a dovetail slot extending generally parallel to the axis of said telescopic sight, a sight element having a dovetail flange slidably engageable with said sliding block, a first means for fixing the position of said sliding block means with respect to said sight ramp and a second means for fixing the position of said sight element with respect to said sliding block.

12. The sight according to claim 11 wherein said sight element is a peep type sight.

13. The sight according to claim 11 wherein a first graduated scale is formed on said sight ramp and said sliding block includes a first index mark which terminates in close proximity with said first graduated scale whereby relative positioning between said sight ramp and said sliding block may be set, and a second graduated scale is formed on said sliding block adjacent said dovetail slot and said sight element includes a second index mark whereby relative positioning between said sight element and said sliding block may be set.

14. The sight according to claim 7 wherein said front sight assembly includes a sight element integral with said upper sight assembly.

15. The sight according to claim 7 wherein said sight elements on said rear sight assembly is adjustable relative to the axis of said telescopic sight.

16. A combination iron sight and mounting bracket for mounting a telescopic sight to a rifle, comprising:

a front sight ring portion having a lower surface releasably attachable to said rifle, a semi-circular interior surface disposed about said telescopic sight, and a slotted top surface, a front sight element having a front sight flange engageable within said slotted surface such that said front sight element may be adjusted in a direction perpendicular to the optical axis of said telescopic sight, a first means extending through said front ring portion and frictionally engageable with said flange, and a rear sight ring portion having a lower surface releasably attachable to said rifle, a semi-circular interior surface disposed upon said telescopic sight and a substantially flat top surface, a rear sight ramp disposed on said upper rear sight ring portion and having an upper surface inclined with respect to said top surface and forming a rear sight flange extending generally parallel to optical axis of said telescopic sight, a sight block having a slotted top sighting surface, and a slotted lower surface engageable with said rear sight flange such that said sight block may be adjusted along said upper surface, a rear sighting element engageable with said slotted top sighting surface such that said rear sighting element is adjustable in a direction perpendicular to said optical axis, a second means extending through said sight block frictionally engageable with said sight ramp, and a third means extending through said sight block frictionally engageable with said rear sight element.

17. A system for mounting a telescopic sight to a firearm with a barrel, comprising:

a forward mounting assembly having a lower forward mounting bracket and a plurality of interchangeable upper forward mounting brackets engageable with said lower forward mounting bracket such that said telescopic sight is held therebetween, at least one of said upper mounting brackets having a front element of an iron sight, and a rear mounting assembly having a lower rear mounting bracket and a plurality of interchangeable upper rear mounting brackets engageable with said lower rear mounting bracket such that said telescopic sight is held therebetween, at least one of said upper mounting brackets having a rear element of an iron sight, said lower rear mounting bracket and said lower forward mounting bracket engageable with said barrel of said firearm such that said telescopic sight and said front and rear elements of an iron sight may alternatively be used to aim said firearm.

18. The system according to claim 17 wherein said front element of said iron sight is integral with said upper forward mounting bracket.

19. The system according to claim 17 wherein said rear element of said iron sight is adjustable relative to the sighting axis of said telescopic sight.

20. A system for providing an alternative sight to a telescopic sight mounted to the barrel of a firearm by two mounting brackets, each mounting bracket having an upper bracket portion and a lower bracket portion for holding the telescopic sight therebetween, comprising:

at least one replacement forward upper bracket portion having a front element of an iron sight and interchangeable with the forward upper bracket portion for mounting said telescopic sight, and at least one replacement rear upper bracket portion having a rear element of an iron sight and interchangeable with the rear upper bracket portion for mounting said telescopic sight, said replacement upper bracket portions being engageable with said lower bracket portions to hold the telescopic sight therebetween such that said telescopic sight and said front and rear elements of an iron sight may alternatively be used to aim said firearm.

21. The system according to claim 20 wherein said rear element of said iron sight is adjustable relative to the sighting axis of said telescopic sight.

* * * * *

UNITED STATES PATENT AND TRADEMARK OFFICE

CERTIFICATE OF CORRECTION

PATENT NO. : 4,841,659

DATED : June 27, 1989

INVENTOR(S) : Paul D. Williams

It is certified that error appears in the above-identified patent and that said Letters Patent is hereby corrected as shown below:

On the title page:

References Cited: U.S. Patent Documents "11/1970" should be --11/1979--;

Col. 1, Line 59, "3,626,579" should be --3,626,597--;

Col. 1, Line 61, "Chestnut" should be --Chesnut--;

Col. 1, Line 61, "Oct." should be --Nov.--;

Col. 2, Line 41, "rare" should be --rear--;

Col. 2, Line 55, insert "view" after --side--;

Col. 2, Lines 63-4 "designed" should be --designated--;

Col. 3, Line 29, "solt" should be --slot--;

Col. 3, Line 31, insert "42" after --block--;

UNITED STATES PATENT AND TRADEMARK OFFICE

CERTIFICATE OF CORRECTION

PATENT NO. : 4,841,659

DATED : June 27, 1989

INVENTOR(S) : Paul D. Williams

It is certified that error appears in the above-identified patent and that said Letters Patent is hereby corrected as shown below:

Col. 3, Line 31, "sild" should be --slid--;

Col. 3, Line 65, insert after "42" --is provided by graduated index marks 66 which are formed on sliding block 42--;

Col. 4, Line 22, insert "rear" after --like--;

Col. 4, Line 30, "Frong" should be --Front--;

Col. 4, Line 33, "Frong" should be --Front--;

Col. 4, Line 48, "desired" should be --desires--;

UNITED STATES PATENT AND TRADEMARK OFFICE

CERTIFICATE OF CORRECTION

PATENT NO. : 4,841,659

DATED : June 27, 1989

INVENTOR(S) : Paul D. Williams

It is certified that error appears in the above-identified patent and that said Letters Patent is hereby corrected as shown below:

Col. 4, Line 54, "betweein" should be --between--;

Col. 4, Line 55, "telescipic" should be --telescopic--;

Col. 4, Line 56, insert "distance" after --sufficient--;

Col. 5, Line 28, Claim 4, "elements" should be --element--;

Col. 6, Line 36, Claim 15, "elements" should be --element--.

Signed and Sealed this

Fifth Day of February, 1991

*Attest:*

*Attesting Officer*

HARRY F. MANBECK, JR.

*Commissioner of Patents and Trademarks*